US006054641A

United States Patent [19]

Inoue

[11] Patent Number: 6,054,641

[45] **Date of Patent: *Apr. 25, 2000**

[54] KEYBOARD MUSICAL INSTRUMENT FOR PRACTICING FINGERING ON KEYBOARD WITHOUT ACOUSTIC SOUNDS

[75] Inventor: Satoshi Inoue, Hamamatsu, Japan

[73] Assignee: Yamaha Corporation, Shizuoka-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/735,260

[22] Filed: Oct. 22, 1996

[30] Foreign Application Priority Data

Oct. 27, 1995 [JP] Japan ..... 7-280744

[51] Int. Cl.[7] ..... G10C 5/00

[52] U.S. Cl. ..... 84/171; 84/172

[58] Field of Search ..... 84/171, 170, 404, 84/470 R, 485 R, 478, 254, 440, 423 R

[56] References Cited

U.S. PATENT DOCUMENTS

| | | | |
|---|---|---|---|
| 855,056 | 5/1907 | Hirschfeld | 84/404 |
| 1,160,409 | 11/1915 | Hicks . | |
| 3,563,125 | 2/1971 | Brocato | 84/237 |
| 3,878,752 | 4/1975 | Yamada | 84/254 |
| 4,217,803 | 8/1980 | Dodds . | |
| 5,247,129 | 9/1993 | Nozaki et al. . | |
| 5,811,702 | 9/1998 | Tomizawa et al. | 84/254 |

FOREIGN PATENT DOCUMENTS

| | | |
|---|---|---|
| 22 38 298 | 2/1973 | Germany . |
| 32 22 578 | 3/1983 | Germany . |
| 196 39 420 | 10/1997 | Germany . |
| 62-208094 | 12/1987 | Japan . |
| 319322 | 9/1929 | United Kingdom . |

*Primary Examiner*—Paul Ip
*Assistant Examiner*—Kim Lockett
*Attorney, Agent, or Firm*—Reed Smith Hazel & Thomas LLP

[57] ABSTRACT

A keyboard musical instrument includes a keyboard, key action mechanisms and hammer assemblies as similar to an acoustic piano; however, strings are replaced with a beaten member so that a player practices a fingering on the keyboard without an acoustic sound; each of the hammer assemblies has a cylindrical hammer head formed of metal or synthetic rubber/synthetic resin, and no twisting moment is exerted on the hammer shank regardless of relative angular position between the hammer head and the hammer shank.

11 Claims, 3 Drawing Sheets

KEYBOARD MUSICAL INSTRUMENT FOR PRACTICING FINGERING ON KEYBOARD WITHOUT ACOUSTIC SOUNDS

FIELD OF THE INVENTION

This invention relates to a keyboard musical instrument and, more particularly, to a keyboard musical instrument for practicing fingering on a keyboard without acoustic sounds.

DESCRIPTION OF THE RELATED ART

A typical example of the keyboard musical instrument is disclosed in Japanese Patent Publication of Examined Application No. 60-44665. The prior art keyboard musical instrument is a kind of training piano, and is similar in structure to an acoustic piano except for vibrative strings.

A standard acoustic piano comprises a keyboard, key action mechanisms functionally connected to the keyboard, a plurality of hammer assemblies respectively driven for rotation by the key action mechanisms and sets of vibrative strings struck with the hammer heads. When one of the black and white keys is depressed from the rest position to the end position, the associated key action mechanism first forces the hammer assembly to turn toward the set of vibrative strings, and causes the hammer assembly to escape therefrom on the way to the end position. Then, the hammer assembly starts a free rotation toward the set of vibrative strings, and rebounds thereon. When the hammer assembly rebounds on the vibrative strings, the vibrative strings vibrate for generating an acoustic sound. However, the acoustic sounds disturb the neighbors. For this reason, the vibrative strings are removed from the prior art keyboard musical instrument, and a beaten member is installed in the prior art keyboard musical instrument. The beaten member is less vibrative than the strings. When a key is depressed, the key action mechanism and the hammer assembly behave as similar to those of the standard acoustic piano. The hammer heads rebound on the beaten member, and sensors pick up the vibrations so as to generate electric signals representative of the vibrations of the beaten member. The electric signals are amplified, and the vibrations are reproduced through a speaker or a headphone.

A hammer butt, a hammer shank and a hammer head form in combination the hammer assembly equipped with the prior art keyboard musical instrument. The hammer head is broken down into two parts, i.e., a hammer wood and an elastic block. The hammer wood is formed of wood, and is attached to the leading end of the hammer shank. The elastic block is formed of felt or rubber, and is attached to the hammer wood in such a manner as to project therefrom. Thus, the hammer assembly of the prior art keyboard musical instrument is same in the structure as the hammer assembly incorporated in the standard acoustic piano.

The manufacturer independently forms the hammer shank, the hammer wood and the elastic block, and, thereafter, assembles these parts into the hammer assembly. For this reason, the fabrication work for the hammer assembly consumes time and labor, and a large number of hammer assemblies increases the production cost of the prior art keyboard musical instrument. Moreover, a worker is expected to carefully assemble the hammer assemblies with the key action mechanisms. If the center line of the hammer head is not parallel to the orbital plane of the hammer shank, the hammer head exerts a twisting moment on the hammer shank during the rotation toward the beaten member and when striking at the beaten member, and the twisting moment destroys the connection between the hammer assembly and the key action mechanisms. In order to prevent the connection between the hammer assembly and the key action mechanism from being destroyed, the worker carefully assembles the hammer assembly with the key action mechanism in such a manner as to make the center line of the hammer head parallel to the orbital plane of the hammer shank. This careful assembling work is time consuming, and further increases production costs.

SUMMARY OF THE INVENTION

It is therefore an important object of the present invention to provide a keyboard musical instrument which is equipped with economically designed hammers.

To accomplish the object, the present invention proposes to form a hammer head from metal or synthetic material such as synthetic resin or synthetic rubber.

In accordance with the present invention, there is provided a keyboard musical instrument comprising: a keyboard having a plurality of keys turnable between rest positions and end positions and respectively assigned notes of a scale; a plurality of key action mechanisms respectively connected to the plurality of keys, and selectively actuated by the plurality of keys when the plurality of keys turn from the rest positions to the end positions; a plurality of hammer assemblies respectively associated with the plurality of key action mechanisms, and starting free rotations at respective escapes from the plurality of key action mechanisms selectively actuated by the plurality of keys, each of the plurality of hammer assemblies including a hammer shank and a hammer head fixed to the hammer shank and formed of a material selected from the group consisting of metal and synthetic material; a beaten means which the plurality of hammer assemblies strike after the free rotations without a substantial acoustic sound; a plurality of sensors for determining at least one key of the keyboard turning from the rest position toward the end position; and a sound generating means for electrically generating a sound with the note assigned to the at least one key.

BRIEF DESCRIPTION OF THE DRAWINGS

The features and advantages of the keyboard musical instrument according to the present invention will be more clearly understood from the following description taken in conjunction with the accompanying drawings in which.

DESCRIPTION OF THE PREFERRED EMBODIMENTS

First Embodiment

Figure 1:
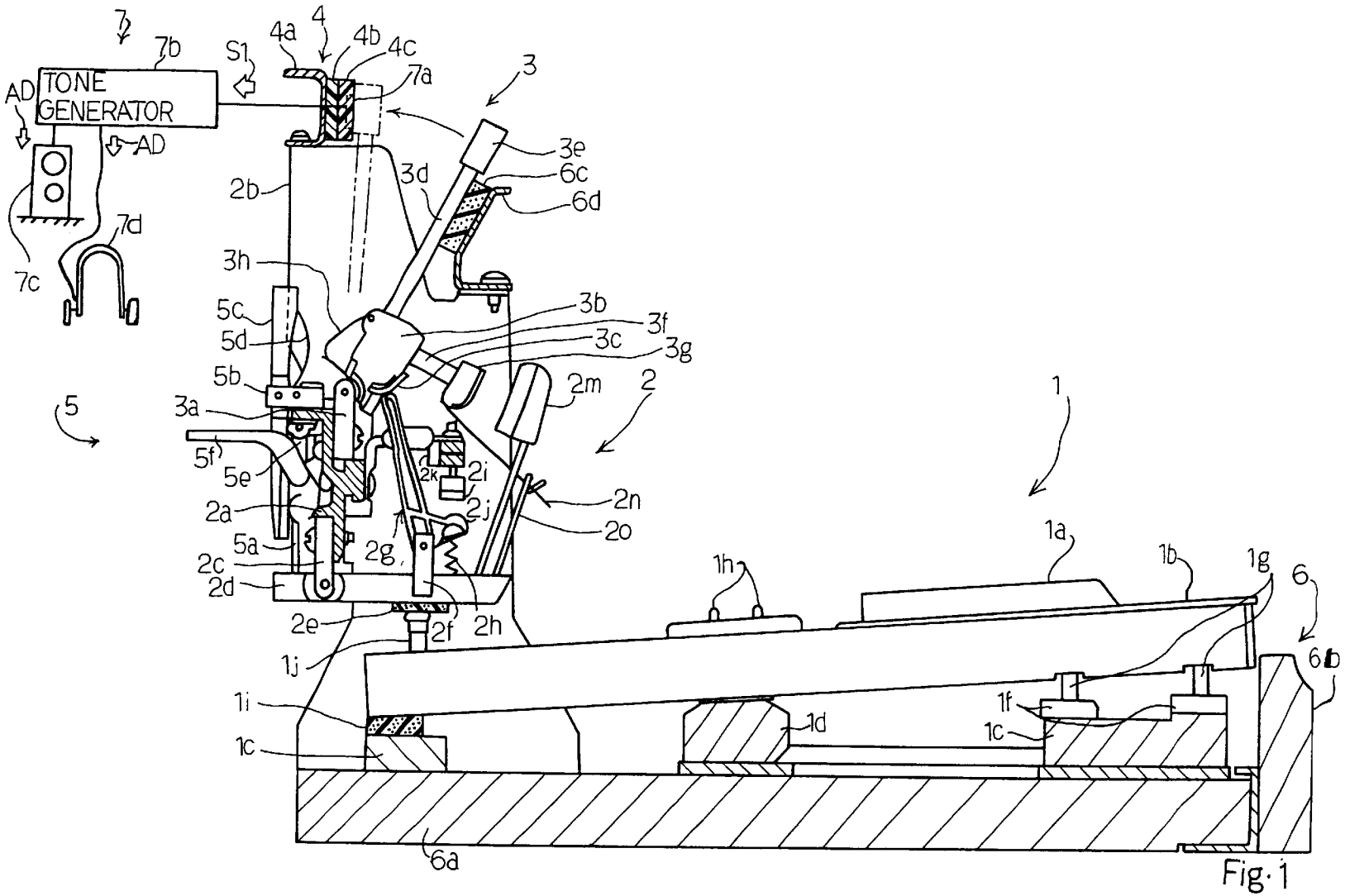
FIG. 1 is a side view showing essential parts of a keyboard musical instrument according to the present invention.

Referring first to FIG. 1 of the drawings, a keyboard musical instrument embodying the present invention largely comprises a keyboard 1, a plurality of key action mechanisms 2 connected to the keyboard 1, a plurality of hammer assemblies 3 respectively driven for rotation by the key action mechanisms 2, a beaten member 4, a plurality of load mechanisms 5 instead of a damper mechanism of an acoustic piano, a piano case 6 for accommodating the component parts 1 to 5 and a sound generating system 7 for electrically generating sounds. In order to clearly illustrate the component parts 1 to 5, the piano case 6 is partially broken, and only a key bed 6*a* and a key slip 6*b* are shown in FIG. 1. The piano case 6 is similar to that of a standard acoustic piano, and no further description is incorporated hereinbelow. In the following description, term "front" means a position closer to a pianist fingering on the keyboard 1 than a "rear" position, and terms "longitudinal" and "lateral" mean a direction between the front position and the rear position and a perpendicular direction to the longitudinal direction, respectively.

Black keys 1*a* and white keys 1*b* form essential parts of the keyboard 1, and are arranged as similar to the black and white keys of a standard acoustic piano. Notes of scale are respectively assigned to the black and white keys 1*a*/1*b*. The keyboard 1 further includes a front rail 1*c*, a balance rail 1*d* and a back rail 1*e*, and these rails 1*c* to 1*e* extend in the lateral direction over the key bed 6*a*. Cloth punchings 1*f* are attached to the front rail 1*c*, and front pins 1*g* upwardly project from the front rail 1*c* so as to restrict the lateral movement of the key. Balance pins 1*h* project from the balance rail 1*d*, and allow the black and white keys 1*a*/1*b* to turn therearound. A back rail cloth 1*i* is attached to the back rail 1*e*, and the back rail cloth 1*i* and the cloth punchings 1*f* absorb the impact of the key. The keyboard 1 further includes capstan buttons 1*j* upwardly projecting from the rear end portions of the black and white keys 1*a*/1*b*, and the black and white keys 1*a*/1*b* are linked with the key action mechanisms 2 through the capstan buttons 1*j*.

While no force is exerted on the front portions of the black and white keys 1*a*/1*b*, the black and white keys 1*a*/1*b* remain in respective rest positions as shown in FIG. 1. When one of the black or white keys 1*a*/1*b* is depressed, the key 1*a*/1*b* is moved from the rest position to the end position where the key is brought into contact with the cloth punchings 1*f*, and the capstan button 1*j* pushes up the key action mechanism 2. Thus, the black and white keys 1*a*/1*b* behave as similar to those of the standard acoustic piano.

The plurality of key action mechanisms 2 are similar in structure to one another, and are respectively associated with the black and white keys 1*a*/1*b*. A center rail 2*a* is shared between the key action mechanisms 2, and the center rail 2*a* is supported by action brackets 2*b*. The action brackets 2*b* are placed on the key bed 6*a*.

The key action mechanism 2 includes a whippen flange 2*c* downwardly projecting from the center rail 2*a*, a whippen 2*d* turnably supported by the whippen flange 2*c* and a whippen heel cloth 2*e* attached to the lower surface of the whippen 2*d*. The capstan button 1*j* is held in contact with the whippen heel cloth 2*e*, and the whippen 2*d* turns in the counter-clockwise direction during movement of the key 1*a*/1*b* from the rest position to the end position.

The key action mechanism 2 further includes a jack flange 2*f* fixed to the whippen 2*d*, a jack 2*g* turnably supported by the jack flange 2*f*, a jack spring 2*h* urging the jack 2*g* in the counter-clockwise direction, a regulating button 2*i* supported through a regulating bracket by the center rail 2*a* in such a manner as to be over the toe 2*j* of the jack 2*g* and a jack stop felt 2*k* attached to the rear surface of the regulating bracket. The regulating button 2*i* is protectable from and retractable into the regulating bracket, and the gap between the toe 2*j* and the regulating button 2*i* is changeable. The jack stop felt 2*k* sets the limit on the turning motion of the jack 2*g*.

While the key 1*a*/1*b* is in the rest position, the jack 2*g* is held in contact with the associated hammer assembly 3, and the toe 2*j* is spaced from the regulating button 2*i*. While the key 1*a*/1*b* is traveling from the rest position to the end position, the jack 2*g* turns in the counter clockwise direction without relative motion to the whippen 2*d*, and causes the hammer assembly 3 to turn toward the beaten member 4. When the toe 2*j* is brought into contact with the regulating button 2*i*, the jack 2*g* quickly turns around the jack flange 2*f* in the clockwise direction, and the hammer assembly 3 escapes from the jack 2*g* so as to dash toward the beaten member 4.

Although the hammer assemblies are enlarged from the lowest pitched tone to the highest pitched tone like a standard acoustic piano, the hammer assemblies 3 are similar in structure to one another, and are respectively driven by the key action mechanisms 2. The hammer assembly 3 includes a butt flange 3*a* attached to the center rail 2*a*, a hammer butt 3*a* turnably supported by the butt flange 3*a*, a butt skin 3*c* attached to the hammer butt 3*b*, a hammer shank 3*d* and a hammer head 3*e* upwardly projecting from the hammer butt 3*b*. The jack 3*c* is held in contact with the butt skin 3*c*, and strongly kicks the butt skin 3*c* at the escape. The hammer shank 3*d* is embedded into the hammer butt 3*b*, and projecting therefrom. While the key 1*a*/1*b* is staying in the rest position, the hammer shank 3*d* is on a hammer rail cloth 6*c* attached to the rear surface of a hammer rail 6*d*. The hammer rail 6*d* is supported by the action brackets 2*b*.

Figure 2:
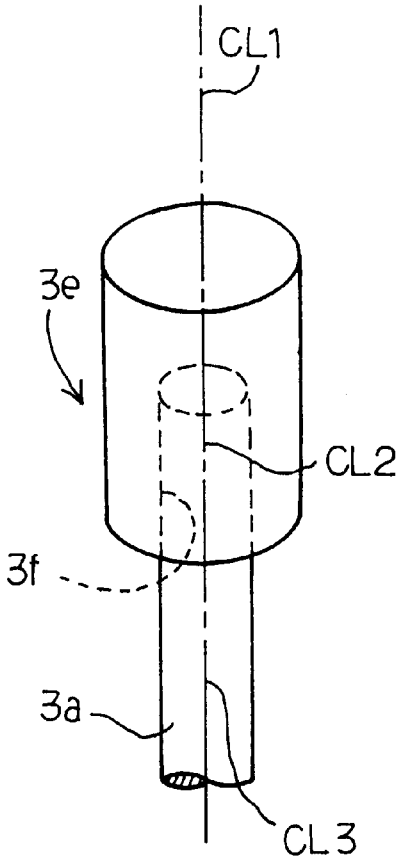
FIG. 2 is a perspective view showing a hammer assembly incorporated in the keyboard musical instrument according to the present invention.

As will be better seen in FIG. 2, the hammer head 3*e* has a cylindrical configuration, and a cylindrical recess 3*f* is formed in the hammer head 3*e*. The cylindrical hammer head 3*e* has a center line CL1, and the center line CL1 is aligned with the center line CL2 of the cylindrical recess 3*f*. The cylindrical recess 3*f* is corresponding to the leading end portion of the hammer shank 3*d*, and the center line CL2 of the cylindrical recess 3*f* is aligned with the center line CL3 of the hammer shank 3*d*. For this reason, the leading end portion of the hammer shank 3*d* is snugly received into the cylindrical recess 3*f*, and the center line CL3 of the hammer shank 3*d* is aligned with the center line CL1 of the hammer head 3*e*.

The leading end portion of the hammer shank 3*d* is fixed to the hammer head 3*e* by welding, adhesion compound or shrinkage fit, by way of example. If the inner surface defining the cylindrical hole 3*f* and the leading portion are threaded, the leading end portion of the hammer shank 3*d* is screwed into the cylindrical hole 3*f*. The threaded engagement between the leading end portion and the hammer head 3*e* is desirable, because the manufacturer can easily change the distance from the hammer butt 3*b* to the top surface of the hammer head 3*e*.

The hammer assembly 3 is symmetrical with respect to any virtual plane aligned with the center lines CL1 to CL3 by virtue of the cylindrical configuration, and, for this reason, unbalancing does not take place in the hammer head 3*e*, and the hammer assembly 3 is free from any twisting moment due to such unbalancing. Even if an assembling worker does not carefully fix the hammer head 3*e* to the hammer shank 3*d*, the unbalancing effect and, accordingly, the twisting moment are negligible, and the connection between the hammer butt 3*b* and the jack 2*g* is hardly broken.

The hammer head 3*e* is formed from metal or synthetic material such as, for example, synthetic resin or synthetic rubber. If metal such as iron is used for the hammer head 3*e*, the hammer head 3*e* may be formed through casting or forging. The hammer head 3*e* may then be molded in synthetic resin. This structure for the hammer head 3*e* reduces the production cost of the keyboard musical instrument, because the hammer head 3*e* is implemented by only one piece. In other words, the hammer head 3*e* does not need any assembling work.

As described hereinbefore, the hammer assemblies 3 are enlarged from the lowest-pitched tone to the highest-pitched tone. The hammer heads 3*e* are appropriately changed in diameter and/or length so as to change the weight thereof. The hammer heads 3*e* may be formed of different materials so as to change the specific gravity and, accordingly, the weight. The hammer heads 3*e* may be machined to form a spiral groove, and the spiral groove changes the weight of the hammer head 3*e*. Otherwise, the hammer heads 3*e* may be shaped in a spindle configuration. If the spindle-shaped hammer heads 3*e* are different in size, the weight is changed between the lowest pitched tone and the highest pitched tone. The hammer heads may be grouped by tone ranges such as, for example, a high-pitched tone range, a middle-pitched tone range and a low-pitched tone range.

Turing back to FIG. 1, the hammer assembly 3 further includes a catcher shank 3*f* projecting from the hammer butt 3*b* at almost right angle with respect to the hammer shank 3*d*, a catcher 3*g* attached to the leading end of the catcher shank 3*f* and a butt spring 3*h* urging the hammer butt 3*b* in the clockwise direction. The catcher 3*g* is positioned opposite a back check 2*m* projecting from the whippen 2*d*, and is connected through a bridle tape 2*o* to a bridle wire 2*o*. The bridle wire 2*o* projects from the whippen 2*d* in the vicinity of the back check 2*m*. The bridle wire 2*o* is moved together with the whippen 2*d*, and the bridle tape 2*n* links the hammer assembly 3 with the motion of the whippen 2*d* after release of the key 1*a*/1*b*. For this reason, the hammer assembly 3 does not strike the beaten member 4 twice. The butt spring 3*h* urges the hammer assembly 3 in the clockwise direction, and presses the hammer shank 3*d* against the hammer rail cloth 6*c* when the key 1*a*/1*b* is in the rest position.

While the key 1*a*/1*b* is in the rest position, the jack 2*g* is engaged with the butt skin 3*c*, and the hammer shank 3*d* is pressed against the hammer rail cloth 6*c*. The jack 2*g* pushes up against the butt skin 3*c* and, accordingly, against the hammer butt 3*b* until the hammer butt 3*b* and, accordingly, the hammer assembly 3 turn around the butt flange 3*a* in the counter clockwise direction. The hammer assembly 3 starts free rotation at when disengaging from the jack 2*g*, and strikes the beaten member 4. The hammer assembly 3 turns in the clockwise direction, and the catcher 3*g* is brought into contact with the back check 2*m*. The bridle tape 2*n* does not allow the hammer assembly 3 to strike the beaten member 4 twice.

When the key 1*a*/1*b* is released, the capstan button 1*j* is sunk together with the rear end portion of the key 1*a*/1*b*, and the whippen 2*d* turns around the whippen flange 2*c* in the clockwise direction. The catcher 3*g* is left from the back check 2*m*, and the jack 2*g* slides into the lower space of the butt skin 3*c*. Thus, the key 1*a*/1*b*, the key action mechanism 2 and the hammer assembly 3 behave similar to those of a standard acoustic piano.

The plurality of load mechanisms 5 are similar to one another, and are respectively associated with the key action mechanisms 2. Each of the load mechanisms 5 includes a damper spoon 5*a* embedded into the rear end portion of the whippen 2*d*, a damper lever flange 5*b* fixed to the center rail 2*a*, a damper lever 5*c* rotatable around the damper lever flange 5*b* and a damper spring 5*d* urging the damper lever 5*c* in the counter clockwise direction. Although a damper wire and a damper head are deleted from the load mechanism 5, the load mechanism 5 is analogous to a damper mechanism of a standard acoustic piano, and gives resistance against the key action mechanism 2 and, accordingly, the key 1*a*/1*b* depressed from the rest position toward the end position.

The load mechanism 5 further includes a lever 5*f* linked with a damper pedal (not shown) and a damper rod 5*e* for spacing the damper lever 5*c* from the damper spoon 5*a*. When the damper pedal (not shown) is depressed, the lever 5*f* causes the damper rod 5*e* to turn in the clockwise direction, and the damper rod 5*e* spaces the damper lever 5*c* from the damper spoon 5*a*. As a result, the load mechanism 5 does not follow the motion of the key 1*a*/1*b*. Thus, the load mechanism 5 behaves similar to a damper mechanism of a standard acoustic piano.

The beaten member 4 includes a bracket 4*a* laterally extending in the piano case 6, a damping layer 4*b* attached to the front surface of the bracket 4*a* and an absorbing layer 4*c* attached to the damping layer 4*b*. The bracket 4*a* is formed of a material with large damping characteristics. Steel is a typical example of a material with large damping characteristics. The damping layer 4*b* is, by way of example, formed of rubber or synthetic resin such as urethane, while rubber, synthetic resin, leather, cloth or felt may be used the absorbing layer 4*c*.

The hammer heads 3*e* strike the beaten member 4, and return to the initial positions on the hammer rail cloth 6*c*. The three-layer beaten member 4 effectively absorbs the impact of the hammer head 3*e*, and does not generate a substantial acoustic sound.

The sound generating system 7 includes a plurality of piezoelectric elements 7*a* embedded in the absorbing layer 4*c*, a tone generator 7*b* connected to the piezoelectric elements 7*a* and a sound system 7*c*/headphone 7*d*. The piezoelectric elements 7*a* correspond to the hammer heads 3*e*, and are respectively struck with the hammer heads 3*e*. When one of the hammer heads 3*e* strikes the associated piezoelectric element 7*a*, the piezoelectric element 7*a* generates an output signal S1, and supplies it to the tone generator 7*b*. The tone generator 7*b* determines the piezoelectric element 7*a* and, accordingly, the key 1*a*/1*b* depressed by a player and the loudness to be given to an electric sound on the basis of the output signal S1. The tone generator 7*b* tailors an audio signal AD representing a selected timbre and the note assigned to the depressed key 1*a*/1*b*, and supplies it to the sound system 7*c* and/or the headphone 7*d*. In this instance, the piezoelectric elements 7*a* serve as the plurality of sensors.

Subsequently, a description will be made on the behavior of the keyboard musical instrument according to the present invention. Assuming now the white key 1*b* is depressed by a player during fingering on the keyboard 1, the white key 1*b* turns around the balance rail 1*d* in the clockwise direction, and capstan button 1*j* pushes up the whippen heel cloth 2*e*.

The whippen 2*d* turns in the counter clockwise direction around the whippen flange 2*c*, and the jack 2*g* pushes up the butt skin 3*c*. The hammer butt 3*b* turns around the butt flange 3*a* in the counter clockwise direction, and the toe 2*j* moves closer and closer to the regulating button 2*i*.

The whippen 2*d* further causes the damper spoon 5*a* to rearwardly push the damper lever 5*c*, and the damper lever 5*c* turns around the damper lever flange 5*b* in the clockwise direction. As a result, the player feels the load on the white key 1*b* as great as usual.

When the toe 2*j* is brought into contact with the regulating button 2*i*, the jack 2*g* quickly turns around the jack flange 2*f*, and causes the hammer butt 3*b* to escape therefrom. The hammer assembly 3 starts a free rotation, and the hammer head 3*e* strikes the beaten member 4 and the associated piezoelectric element 7*a*. When the hammer butt 3*b* escapes from the jack 2*g*, the player can feel the white key 1*b* as being lighter. Thus, the key action mechanism 2, the hammer assembly 3 and the load mechanism 5 give the unique piano key touch to the player.

The piezoelectric element 7*a* generates the output signal S1 representative of the depressed white key 1*b* and the intensity of the impact, and the tone generator 7*b* tailors the audio signal AD on the basis of the pieces of music information represented by the output signal S1. The sound system 7*c* and/or headphone generates an electric signal from the audio signal AD.

After striking, the hammer assembly 3 turns in the clockwise direction, and the catcher 3*g* is brought into contact with the back check 2*m*. When the depressed white key 1*b* is released, the capstan button 1*j* is sunk together with the rear end portion of the white key 1*b*, and the whippen 2*d* turns around the whippen flange 2*c* in the clockwise direction. The jack 2*g* is brought into contact with the butt skin 3*c*, again, and all the component parts return to their initial positions.

As will be appreciated from the foregoing description, the keyboard musical instrument allows a player to practice fingering on the keyboard 1 without a substantial acoustic sound. The keyboard musical instrument gives the unique piano key touch to the player, and the electric sound generating system 7 allows the player to confirm the fingering through the electric sounds. The hammer heads 3*e* have cylindrical configuration, and do not exert a twisting moment on the hammer shank 3*d*. The hammer head 3*e* is one piece, and the manufacturer can easily form it without any assembling work. As a result, the keyboard musical instrument may be assembled with reduced production costs.

Second Embodiment

Figure 3:
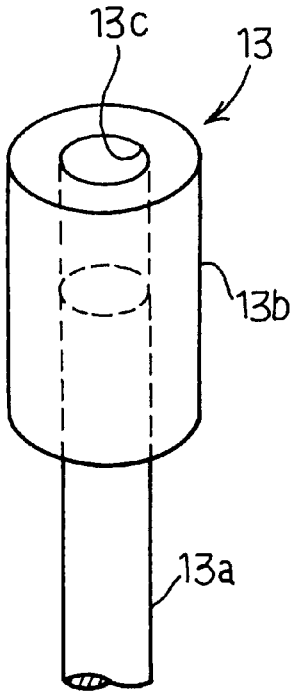
FIG. 3 is a perspective view showing a hammer assembly incorporated in another keyboard musical instrument according to the present invention.

Turning to FIG. 3 of the drawings, a hammer assembly 13 forms a part of a keyboard musical instrument embodying the present invention. The other parts of the keyboard musical instrument implementing the second embodiment are similar to those of the first embodiment, and this description will be focused on the hammer assembly 13 for the sake of simplicity.

The hammer assembly 13 includes a hammer butt (not shown), a hammer shank 13*a* projecting from the hammer butt, a hammer head 13*b* fixed to the leading end portion of the hammer shank 13*a* and a catcher (not shown) projecting from the hammer butt in such a manner as to be almost at a right angle with respect to the hammer shank 13*a*.

The hammer shank 13*a* has a circular cross section, and the hammer head 13*b* has a cylindrical configuration. A cylindrical through-hole 13*c* is formed in the cylindrical hammer head 13*b*, and the center line of the hammer head 13*b* is aligned with the center line of the cylindrical through-hole 13*c*. The leading end portion of the hammer shank 13*a* is inserted into the cylindrical through-hole 13*c*, and is fixed to the hammer head 13*b*.

The cylindrical hammer head 13*b* is symmetrical with respect to any virtual plane aligned with the center line thereof, and a twisting moment is never exerted on the hammer shank 13*a* regardless of the relative angular position between the hammer head 13*b* and the hammer shank 13*a*.

The keyboard musical instrument implementing the second embodiment achieves all the advantages of the first embodiment.

Third Embodiment

Figure 4:
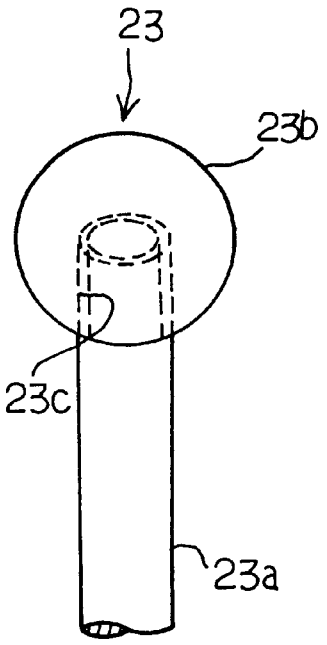
FIG. 4 is a perspective view showing a hammer assembly incorporated in yet another keyboard musical instrument according to the present invention.

Turning to FIG. 4 of the drawings, a hammer assembly 23 forms a part of a keyboard musical instrument embodying the present invention. The other parts of the keyboard musical instrument implementing the third embodiment are similar to those of the first embodiment, and description is focused on the hammer assembly 23 for avoiding repetition.

The hammer assembly 23 includes a hammer butt (not shown), a hammer shank 23*a* projecting from the hammer butt, a spherical hammer head 23*b* fixed to the leading end portion of the hammer shank 23*a* and a catcher (not shown) projecting from the hammer butt in such a manner as to be at a right angle with respect to the hammer shank 23*a*.

A cylindrical recess 23*c* is formed in the spherical hammer head 23*b*, and the inner surface defining the cylindrical recess 23*c* is threaded. The center line of the cylindrical recess 23*c* passes through the center of spherical hammer head 23*b*, and a threaded leading end portion of the hammer shank 23*a* is screwed into the spherical hammer head 23*b*.

The cylindrical hammer head 23*b* is symmetrical with respect to any virtual plane aligned with the center line of the cylindrical recess 23*c*, and a twisting moment is never exerted on the hammer shank 13*a* regardless of the relative angular position between the hammer head 23*b* and the hammer shank 23*a*.

The keyboard musical instrument implementing the third embodiment achieves all the advantages of the first embodiment.

Although particular embodiments of the present invention have been shown and described, it will be obvious to those skilled in the art that various changes and modifications may be made without departing from the spirit and scope of the present invention.

Figure 5:
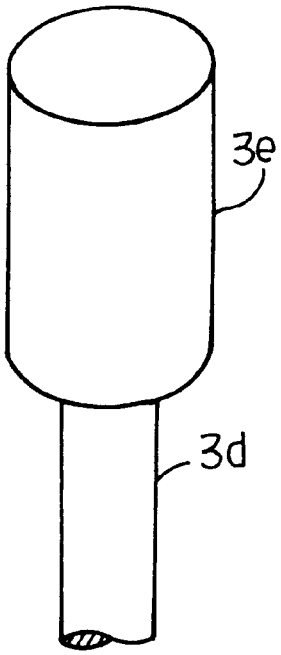
FIG. 5 is a perspective view showing a hammer head integral with a hammer shank.
Figure 6:
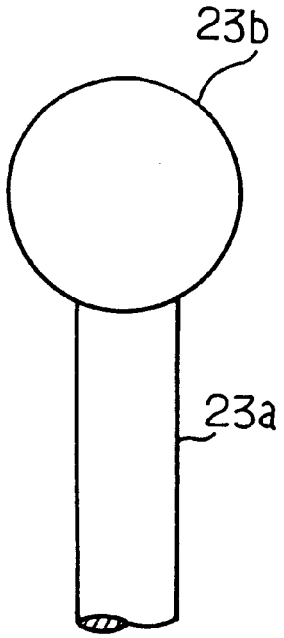
FIG. 6 is a perspective view showing another hammer head integral with a hammer shank.

For example, the hammer head 3*e*/23*b* may be integral with the hammer shank 3*d*/23*a* as shown in FIGS. 5 and 6, and the hammer head and the hammer shank may be formed of metal or synthetic material such as, for example, synthetic resin or synthetic rubber. Moreover, the hammer head, the hammer shank and the hammer butt or the hammer head, the hammer shank, the hammer butt and the catcher may be integrally formed as one piece.

The hammer head may be shaped into a plate-like configuration.

Key-sensors may be provided under the keyboard 1 so as to directly catch key motions. The key sensor may be implemented by a piezoelectric element, a photo-sensor such as a photo-interrupter and a shutter plate attached to a key. The tone generator may estimate a key velocity on the basis of time interval between photo-interruptions by the shutter plate.

The key action mechanisms and the hammer assemblies may be those of a grand piano, and a keyboard musical instrument may be fabricated on the basis of a harpsichord, a celesta or an organ.

A plurality of key sensors and/or a plurality of hammer sensors are available for detecting the hammer motions.

What is claimed is:

1. A keyboard musical instrument for practicing fingering, comprising:

a keyboard having a plurality of keys turnable between rest positions and end positions and respectively assigned notes of a scale;

a plurality of key action mechanisms respectively connected to said plurality of keys, and selectively actuated by said plurality of keys when said plurality of keys turn from said rest positions to said end positions;

a plurality of hammer assemblies respectively associated with said plurality of key action mechanisms, and starting free rotations at respective escapes from said plurality of key action mechanisms selectively actuated by said plurality of keys, each of said plurality of hammer assemblies including a hammer shank and a hammer head fixed to said hammer shank so as to be moved together with said hammer shank associated therewith during the free rotations, said hammer head having a cylindrical configuration having a center line aligned with a center line of said hammer shank, and said hammer head being elongated along said center line thereof aligned with said center line of said hammer shank;

a beaten means which said plurality of hammer assemblies strike after said free rotations without a substantial acoustic sound;

a plurality of sensors for determining at least one key of said keyboard turning from said rest position toward said end position; and a sound generating means for electrically generating a sound with the note assigned said at least one key.

2. The keyboard musical instrument as set forth in claim 1, in which said hammer head is integral with said hammer shank.

3. The keyboard musical instrument as set forth in claim 1, further comprising a plurality of load mechanisms each associated with one of said plurality of key action mechanisms for giving a resistance against a motion of said one of said plurality of key action mechanisms as if a damper mechanism of an acoustic piano is provided for said one of said plurality of key action mechanisms.

4. The keyboard musical instrument as set forth in claim 1, wherein said hammer head is formed of metal or synthetic resin.

5. The keyboard musical instrument as set forth in claim 1, in which the hammer heads of said plurality of hammer assemblies are changed in weight from the hammer head associated with the key assigned the lowest-pitched tone to the hammer head associated with the key assigned the highest-pitched tone.

6. The keyboard musical instrument as set forth in claim 1, in which the hammer heads of said plurality of hammer assemblies are divided into a plurality of hammer groups, and the hammer heads in one of said plurality of hammer groups are different in weight from the hammer heads in the others of said plurality of hammer groups.

7. The keyboard musical instrument as set forth in claim 6, in which said plurality of hammer groups are respectively associated with the keys respectively assigned tone ranges.

8. The keyboard musical instrument as set forth in claim 7, in which said tone ranges are a high-pitched tone range, a middle-pitched tone range and a low-pitched tone range.

9. The keyboard musical instrument as set forth in claim 1, wherein each of said plurality of key action mechanisms includes component members forming in combination a key action mechanism incorporated in an acoustic piano.

10. The keyboard musical instrument as set forth in claim 1, wherein each of said plurality of key action mechanisms includes:

a whippen assembly turnably supported by a stationary member forming a part of a case and driven for rotation by an associated one of said plurality of keys; and a jack turnably supported by said whippen assembly and brought into contact with a regulating button during the rotation of said whippen assembly so as to allow an associated hammer butt of one of said plurality of hammer assemblies to escape therefrom.

11. The keyboard musical instrument for practicing fingering as set forth in claim 1, wherein said hammer head is thicker than said hammer shank.

* * * * *